United States Patent [19]

Davister

[11] Patent Number: 5,031,371

[45] Date of Patent: Jul. 16, 1991

[54] COMPONENTS AND CONNECTOR MEANS FOR A MODULAR BUILDING STRUCTURE SYSTEM

[76] Inventor: Michael D. Davister, 4708 Carterwood Dr., Fairfax, Va. 22032

[21] Appl. No.: 420,890

[22] Filed: Oct. 13, 1989

[51] Int. Cl.[5] ..... E04B 1/343

[52] U.S. Cl. ..... 52/236.1; 52/280; 403/170

[58] Field of Search ..... 52/82, 79.4, 236.1, 52/81, 712, 715, 280; 403/171, 172, 170

[56] References Cited

U.S. PATENT DOCUMENTS

| | | | |
|---|---|---|---|
| 3,452,493 | 7/1969 | Mims | 52/236.1 |
| 3,633,325 | 1/1972 | Bartoli | 52/82 |
| 3,686,812 | 8/1972 | Rensch | 52/236.1 |
| 4,501,512 | 2/1985 | Hiltz | 403/170 |
| 4,566,818 | 1/1986 | Schwartz | 52/81 |
| 4,671,693 | 6/1987 | Rossman | 52/81 |

FOREIGN PATENT DOCUMENTS

| | | | |
|---|---|---|---|
| 251271 | 9/1976 | Fed. Rep. of Germany | 52/79.4 |
| 581193 | 10/1946 | United Kingdom | 52/236.1 |

*Primary Examiner*—John E. Murtagh

[57] ABSTRACT

A structural system of modular components which promotes rapid erection of building type structures is disclosed. The modular building structure system comprises a plurality of beam members, a plurality of column support members, and a connector means for affixing the beam members into a structural gridwork. Each beam member is positioned between and aligned with two nodes of a planar assemblage of interconnected polygons to form a structural gridwork that is congruent with the planar assemblage of interconnected polygons. The column support members are positioned between two structural gridworks and aligned with two nodes, one node being in each structural gridwork. The column support members include endpieces enabling the column support members to be affixed to the structural gridwork. The connector means comprises a plurality of tubular hubs positioned at the nodes of the structural gridworks and a plurality of radial flange sets. The radial flange sets include a plurality of radial flanges spaced circumferentially around the tubular hub and extending in the directions of the beam members. The radial flanges are enabled to affix to the sides of the tubular hub and the beam members are enabled to affix to the radial flanges.

22 Claims, 8 Drawing Sheets

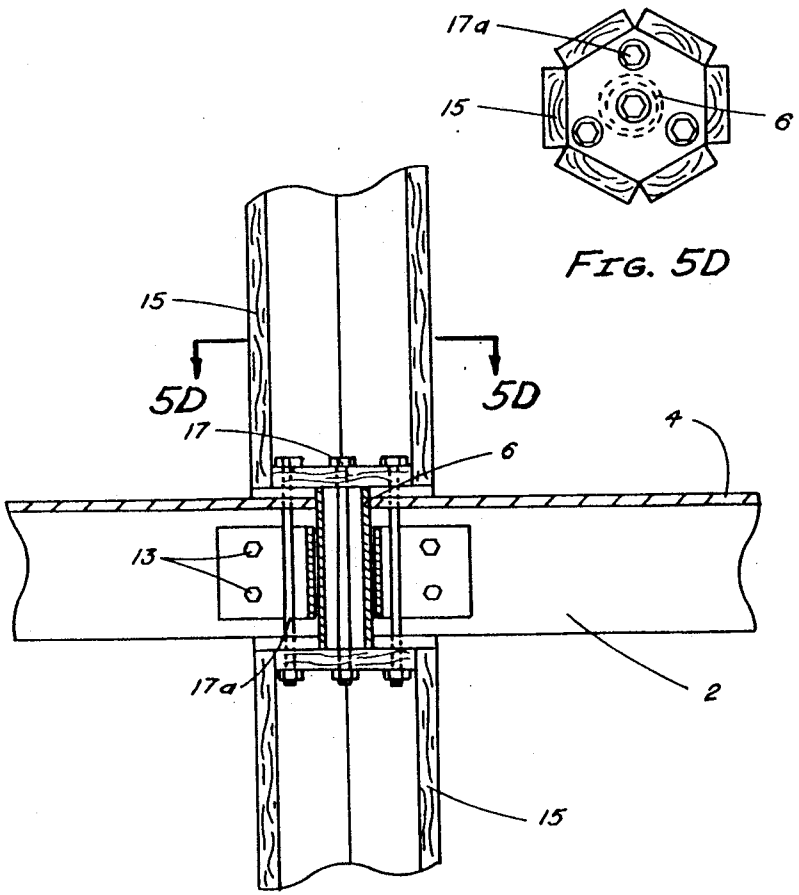
FIG. 5D
FIG. 5A
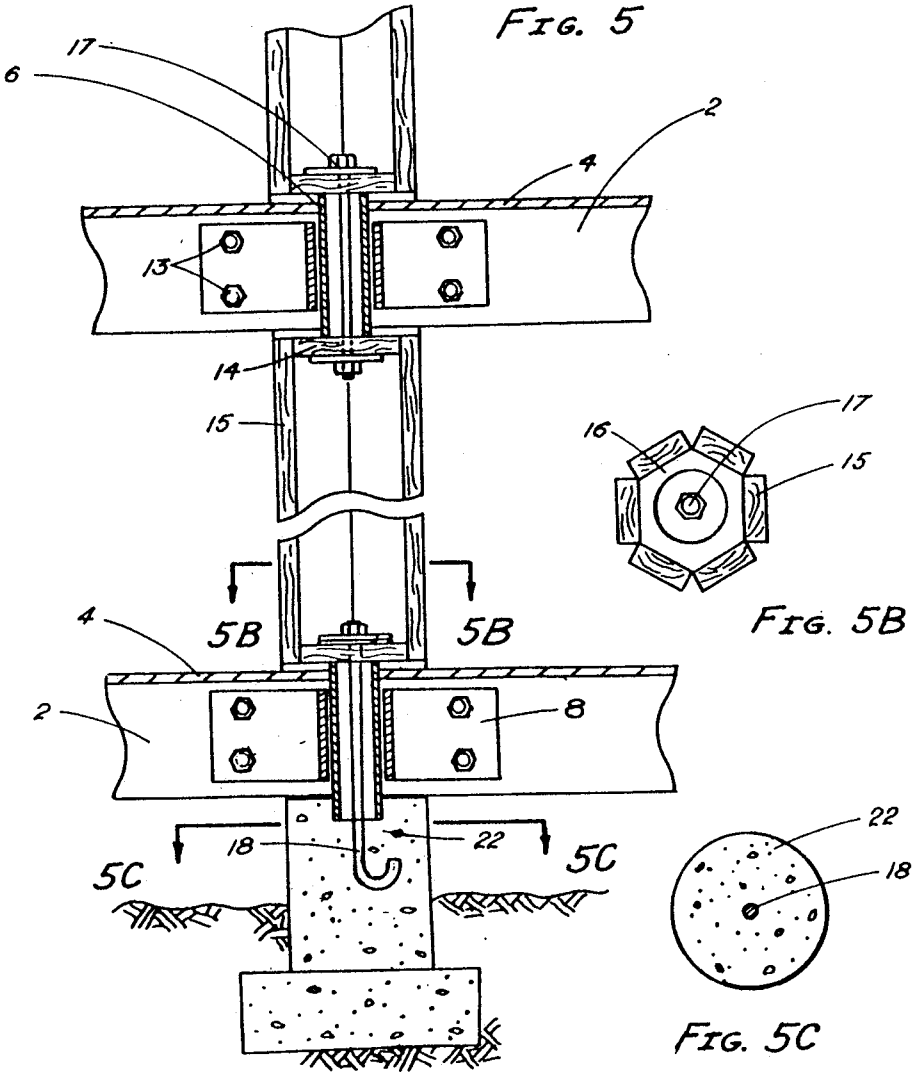
FIG. 5
FIG. 5B
FIG. 5C

COMPONENTS AND CONNECTOR MEANS FOR A MODULAR BUILDING STRUCTURE SYSTEM

BACKGROUND OF THE INVENTION

1. Field of the Invention

The present invention relates to manufactured modular building structures. Specifically the invention relates to the structural components and connectors used to erect a framework comprising gridworks of interlocking polygons covered by rigid panels, column support members, and roof framing members.

2. Description of the Background Art

Manufactured structures that are fabricated in a factory and assembled on site generally means a better quality more precise structure with less time spent on site during construction. The largest application of manufactured structures is the housing industry. Approximately 10 to 15% of the new starts in housing may be classified as manufactured housing. As far back as 1972, it was predicted that manufactured or pre-engineered housing would be an intense competitor in the home building industry. This has not yet happened in the United States, although it did in Japan and in Scandinavian countries.

Besides having the potential to offer a better quality home, manufactured housing can help solve the worldwide problem of a need for affordable housing. For example, the annual housing needs of the United States require approximately 2.5 million new starts. Unfortunately, only 1.8 million units are constructed annually. This cumulative gap affects our society and the quality of life. Affordable housing will be possible when construction costs are reduced by the rapid erection of factory made components using innovative construction technology. None of the existing manufactured systems are sufficiently advanced to solve this current problem.

There are at least 500 companies in the United States offering various systems that may be considered as manufactured homes. Available types of manufactured housing are generally classified as modular, panelized, precut, and domes.

Modular homes are those shipped in sections on flatbed trucks and lifted into place by cranes onto a standard foundation prepared in advance. The modular sections arrive on the site about 90 per cent complete. Sections are joined, utilities hooked up, and siding applied. Generally, the time to complete a structure is one month. The mode of transportation limits the size of present modular systems and the customer is usually limited to selection from a few standard models.

Panelized houses include prebuilt wall sections and may also include roof and floor sections. Panels and sections are assembled, delivered by truck, and erected over a standard foundation. Manufacturer representatives erect the walls, put sections in place, and finish the house in a conventional manner. There is some design flexibility with panelized homes, but generally they appear box-like and lack architectural appeal. Precut houses are sold as packages providing all the components necessary to enclose the structure shell. Each component is cut and coded at the factory, then shipped to the site with a detailed instruction manual. Erection is done by a manufacturer representative, a builder, or the owner. The largest segment of the precut industry is log homes. The cost of building a precut home is comparable to that of conventional structures and the customer is usually limited to choosing from a set of standard designs.

A network of interlocking triangles is used to construct a dome structure. Based on R. Buckminster Fuller's geodesic dome, it is shipped as a precut and coded kit. The kit includes wood framing, plywood sheathing, steel connectors, straps, hardware, windows, and doors. Although dome structures can be very appealing, they are often disallowed by many homeowner's associations.

All of these manufactured housing types have several disadvantages including the need for a structural foundation, difficulties in transportation to the constructing site, being nearly as costly as conventional housing, use of heavy machinery to handle components at the job site, inability to readily accommodate future expansion, unacceptable appearance to existing communities, limited to a few standard models, and being restricted in architectural form. For these reasons, a general inability to provide aesthetic architectural manufactured housing at a reasonable cost exists and explains why manufactured housing still has a relatively small percentage of the housing market in the United States.

Specific objectives and advantages of the present invention over existing manufactured housing systems are:

a) to provide a modular structural system which does not require a substantial foundation;

b) to provide a modular structure which supplies the first-time buyer with a basic structure and facilitates future expansion by adding modules while existing components are removed and reinstalled;

c) to provide a modular structural system with a great deal of flexibility relating to room layout, architectural style, structure size, and degree of customization;

d) to provide structural components which can be manufactured to withstand the rigors of transportation and be handled at the construction site without the use of heavy machinery;

e) to provide a structural system in which the components can be rapidly and easily joined on site by unskilled laborers;

f) to provide a structural system with improved strength characteristics over both conventional and presently available systems for manufactured housing;

g) to provide a structural system which inherently provides construction precision due to characteristics of the components; and h) to provide a structural system which preserves traditional architectural values as well as takes advantage of technological developments.

SUMMARY OF THE INVENTION

The invention is a modular building structure system comprising a plurality of beam members, a plurality of column support members, and a connector means for affixing the beam members into a structural gridwork. Each beam member is positioned between and aligned with two nodes of a planar assemblage of interconnected polygons to form a structural gridwork that is congruent with the planar assemblage of interconnected polygons. The column support members are positioned between two structural gridworks and aligned with two nodes, one node being in each structural gridwork. The column support members include endpieces enabling the column support members to be affixed to the structural gridwork. The connector means comprises a tubular hub and a radial flange set positioned at each node of the structural gridworks. The radial flange sets include a plurality of radial flanges spaced circumferentially around the tubular hub and extending in the directions of the beam members. The radial flanges are enabled to affix to the tubular hub and the beam members are enabled to affix to the radial flanges.

The invention is a connector means for assemblage of a structural framework. The connector means comprises a tubular hub, a set of radial flanges, and a column bolt/nut unit. The tubular hub is positioned centrally at a node of a structural gridwork of beam members. The radial flange set comprises a plurality of radial flanges spaced circumferentially around the tubular hub and extending in the directions of the beam members. The radial flanges are enabled to affix to the sides of the tubular hub and the beam members are enabled to affix to the radial flanges. A column bolt/nut unit comprises threaded rods, a plurality of washers, and a nut; the threaded rods passing through or peripheral to the tubular hub and extending the length of the tubular hub with projections sufficiently long to enable the column bolt/nut unit to affix an endpiece of a column support member to the tubular hub.

BRIEF DESCRIPTION OF THE DRAWINGS

FIG. 5 illustrates a connector means for structural attachment of column support members to a structural gridwork of beam members and a means for anchorage to a structural foundation.

FIG. 5*a* illustrates a connector means for structural attachment of two column support members to a structural gridwork of beam members.

FIG. 5*b* is a cross section through a column support member. FIG. 5*c* is a cross sectional view through the structural foundation.

FIG. 5*d* is a cross sectional view through a column support member illustrating the use of addition bolt/nut units.

Figure 1A:
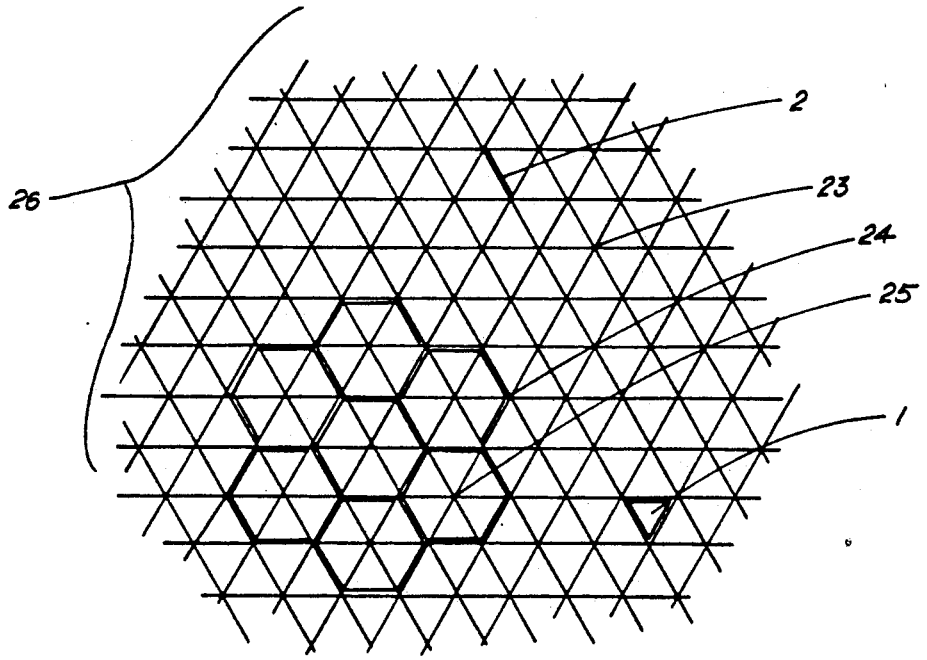
FIG. 1*a* illustrates a planar assemblage of interconnected polygons or triangles.

REFERENCE NUMERALS IN DRAWINGS 1. triangular unit
2. beam members
3. interior support members
4. rigid support panel
5. column support member
6. tubular hub
7. radial flanges
8. radial flange pair
9. radial flange set
10. inner tubular sleeve
11. spacer tube
12. radial bolt/nut unit
13. circumferential bolt/nut unit
14. column endpiece
15. column stanchion
16. lateral column ties
17. column bolt/nut unit 17*a*. peripheral column bolt/nut unit 18. anchor bolt unit
19. roof framing member
20. elongated tubular hub
21. second set of radial flanges
22. structural foundation
23. node
24. exterior node
25. interior node
26. planar assemblage of interconnected triangles
27. angle connectors
28. access cover panel
29. structural gridwork
30. wall units

DETAILED DESCRIPTION OF THE INVENTION

The invention is a structural system of modular components which promotes rapid erection of building type structures. The modular building structure system comprises a plurality of beam members, a plurality of column support members, and a connector means for affixing the beam members into a structural gridwork. Each beam member is positioned between and aligned with two nodes of a planar assemblage of interconnected polygons to form a structural gridwork that is congruent with the planar assemblage of interconnected polygons. The column support members are positioned between two structural gridworks and aligned with two nodes, one node being in each structural gridwork. The column support members include endpieces enabling the column support members to be affixed to the structural gridwork. The connector means comprises a tubular hub and a radial flange set positioned at each node of the structural gridworks. The radial flange sets include a plurality of radial flanges spaced circumferentially around the tubular hub and extending in the directions of the beam members. The radial flanges are enabled to affix to the tubular hub and the beam members are enabled to affix to the radial flanges.

The invention is a connector means which promotes the rapid erection of a structural framework of beam members and column support members. The connector means comprises a tubular hub, a set of radial flanges, and column bolt/nut units. The tubular hub is positioned centrally at a node of a structural gridwork of beam members. The radial flange set comprises a plurality of radial flanges spaced circumferentially around the tubular hub and extending in the directions of the beam members. The radial flanges are enabled to affix to the sides of the tubular hub and the beam members are enabled to affix to the radial flanges. A column bolt/nut unit comprises a threaded rod, a plurality of washers, and a nut; the threaded rods passing through or peripheral to the tubular hub and extending the length of the tubular hub with projections sufficiently long to enable the column bolt/nut unit to affix an endpiece of a column support member to the tubular hub.

The basis of this invention is a highly modular building structure system which can be economically manufactured and rapidly erected offering a high degree of precision, structural integrity, and architectural style. This modular system embodies a framework comprising gridworks of beam members arranged in geometrically and structurally favorable configurations, and supported by an array of strategically positioned column members. This modular building structure system employs a connector means which facilitates rapid assembly o f various arrangements of the beam members into a structural gridwork and the attachment of the gridwork to the column support members. The connector means also enables the attachment of roof framing members in various configurations to promote architecturally pleasing effects consistent with the geometric assemblage of modular units.

This modular building structure system is highly suitable for timber construction utilizing structural grade dimensional lumber. It is particularly useful for residential construction utilizing nominal two inch thick lumber and commercial structures utilizing larger timber components.

The connector means used for affixing the beam members into a structural gridwork is a tubular hub to which radial flanges are attached. The radial flanges are manufactured and affixed such that they extend in the directions of the beam members. Any number of flanges may be attached to a tubular hub enabling an infinite number of different arrangements of the beam members. Arranging the beam members specifically to form an interconnected assemblage of triangular units gives the structural gridwork a great deal of inherent strength. If equilateral triangle are used, a high degree of modularity evolves as does the basic hexagonal shaped regions which serve as the basic room units. The triangular units may be of any size necessary to accommodate the desired room or structure size. However, especially for residential construction, it is desirable to size triangular units based on the standard four foot by eight foot panels common to the building industry. Cutting this standard size panel along a bisecting line making a thirty degree angle with the eight foot edge, yields two panels that can be positioned to cover an equilateral triangular area approximately 8.6 feet on a side. The combined area of six such triangles when fitted into a hexagonal region is approximately 193 square feet or the equivalent of approximately a fourteen foot square room. This size room is particularly appropriate for residential construction. Additional cuts are made to the panel to provide an access at each vertex to affix triangular units with attached rigid panels to the tubular hubs. An access cover, cut from a strip of rigid panel material is used to close the access area and enhance the structural connection of the beam members at a tubular hub.

The tubular hub can be cut from structural steel pipes which are circular or hexagonal in cross section. Hexagonal cross sections provide a better contact surface for bolting radial flange pairs to the tube. Typical tube diameters range from three inches to nine inches. The length of the tubular hubs is somewhat longer than the depth of the beam members making up the structural gridwork. This enables the tubular hubs to project a small distance varying from one to two inches into the column endpieces enabling lateral shear transfer between the column support members and the structural gridwork. Typical tubular hub lengths vary from 10 inches for residential construction to 24 inches for larger commercial structures.

Several options are available for affixing the radial flanges to the tubular hubs. Rectangular plates may be welded directly to the tubular hub. In this case, the beam members are affixed to the radial flanges with circumferential bolt/nut units. Radial flange pairs fabricated by twice bending a rectangular plate to form a flange an each side of a central segment enables the flanges to be bolted to the tubular hub; the central segment enabled to receive radial bolt/nut units.

Radial flange pairs may also be used to affix three beam members into a triangular unit employing one radial flange pair at each vertex. In this case, radial bolt/nut units are used to affix the radial flange pair to the tubular hub. Also, a tubular spacer is slide over the otherwise exposed portion of the bolt between the bolting surface of the radial flange pair and the tubular hub. The spacer improves the strength of the connection by transferring compression forces between the triangular unit and the tubular hub.

Instead of radial flange pairs, angle connectors may be used for affixing three beam members into a triangular unit. In this case, circumferential bolt/nut units are used to affix the triangular units to the radial flanges.

A pattern of holes in the radial flanges enable the beam members to be affixed to the tubular hub with circumferential bolt/nut units. The beam members may be affixed as single components or as part of a triangular unit with affixed rigid panels. Either one beam member may be positioned on each side of a radial flange or a single member may have kerfed ends to receive the radial flange.

Interior support members provide additional support to the rigid panels used for floors and ceilings. Numerous possibilities exist for the geometric arrangement of the interior support members. As examples, they may be arranged to form smaller triangular units; or they may be aligned parallel or perpendicular to one of the sides of the triangular units. Interior support members are affixed to the beam members or to the hardware at the vertices used to assemble the beams into triangular units. Existing hardware commonly used as beam hangers or minor modifications thereof can be used to affix the interior support members to the beam members.

Threaded rods extending the length of the tubular hub and projecting through the member endpieces can be used to affix the column support members to the tubular hubs and to the structural foundation. The rods can pass through or peripheral to the tubular hub. A hollow column fabricated from column stanchions removably affixed to lateral column ties enables the threaded rods to be inserted and the nuts tightened. Generally, only one of the stanchions needs to be removable. When the stanchions provide a flat surface perpendicular to a line connecting adjacent columns, the wall units may be easily affixed to the stanchion in a manner which effectively helps to resist lateral loads imposed on the building structure. Thus, hexagonal shaped endpieces and lateral ties, and stanchions of rectangular cross sections are desirable for a hexagonal gridwork. The endpieces and lateral ties may be cut from two inch thick nominal lumber or fabricated from steel plates with provision for attaching the column stanchions. The column stanchions can be cut from structural lumber of suitable size to support the design loads. The hollow spaces of the columns can also be used for electrical, plumbing, and ventilating conduits.

In the event the building design calls for a flat roof, the top most gridwork surfaced with appropriate roofing materials will suffice. To accommodate those cases where sloping roofs are desired, elongated tubular hubs enable roof framing members to be affixed to the structural framework. Elongated tubular hubs have two sets of radial flanges, one at each end of the tubular hub. The first set is affixed to the upper most gridwork while the second set is used for affixing the roof framing members. A radial flange of the second set extends in the direction of the roof framing members and commonly makes an acute angle with the axis of the tubular hub. Radial flange pairs to accommodate the inclined directions of the roof framing members can be fabricated by bending rectangular plates along lines making corresponding angles with the edges of the plate. An elongated tubular hub can be affixed to the structural framework with a threaded rod extending the length of the elongated tubular hub and projecting through the endpiece of the column below and a large anchor disk or washer above. Conventional roof framing rafters can be affixed to the roof framing members for providing additional support to the panels used for the roof covering.

Prefabricated wall units extend from column to column to enclose the structure and to subdivide the building area into rooms. A large amount of standardization may be achieved for the fabrication of the wall units since the majority of these will be of the same size.

From the description above, a number of advantages of the modular building structure system and connector means are evident:

a) the use of column support members enables the structure to be supported by an array of individual footings and does not require a substantial foundation;
b) a basic structure can be built of hexagonal modules and easily expanded for future needs permitting a great deal of planning flexibility and easing the financial burden on the first-time home buyer;
c) the modular structural system offers a great deal of flexibility relating to room layout, architectural style, structure size, and degree of customization;
d) the structural components including floors, columns, walls, and connectors can be manufactured utilizing assembly line technology and easily transported to the construction site;
e) the connector means permits the components to be rapidly and easily joined on site by unskilled laborers;
f) the structural gridwork of interconnected triangular polygons has improved strength characteristics over both conventional and presently available systems for manufactured housing;
g) the characteristics of the triangle inherently provides a high degree of construction precision; and
h) the infinite number of possible arrangements of the polygonal units horizontally and vertically, and the infinite number of possible roof coverings enable traditional architectural styles to be preserved while taking advantage of technological developments.

The invention is described in more detail with reference to the figures which illustrate the desirable embodiment of the structural gridwork, column support members, and connector means.

FIG. 1*a* is a plan view which schematically illustrates a planar assemblage of interconnected triangles 26 which are further arranged to form a pattern of interconnected hexagons. Beam members 2 can be positioned between the nodes 23 of the planar assemblage to form a triangular unit 1. Six triangular units 1 form a hexagon which has six exterior nodes 24 and one interior node 23. Column support members 5 are typically placed at the six exterior nodes 24 of a hexagon. Typically, the interior node 25 of each hexagon does not have a column support member 5.

Figure 1B:
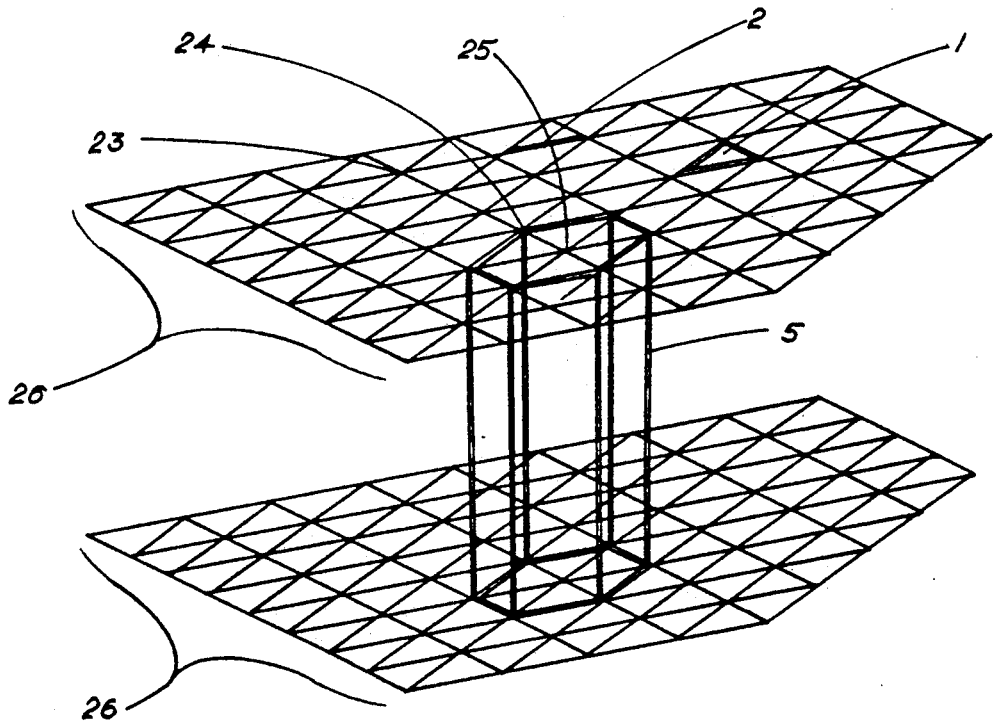
FIG. 1*b* illustrates the positioning of the column support members between two planar assemblages of interconnected polygons.

FIG. 1*b* is an isometric view schematically illustrating column support members 5 fitted between two planar assemblages of interconnected triangles 26. The nodes 23 at each column end are vertically aligned.

Figure 2A:
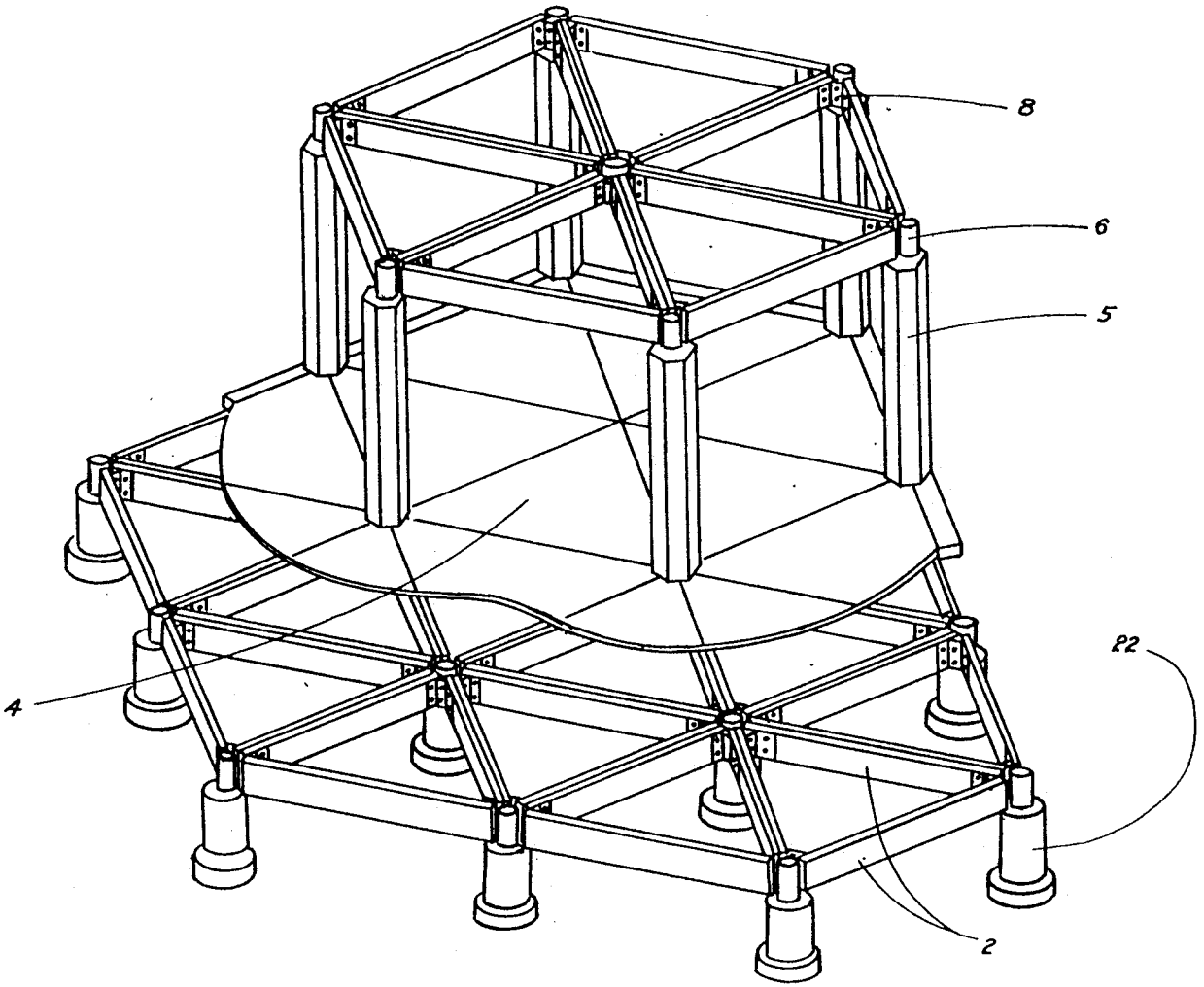
FIG. 2*a* is an isometric view illustrating a framework of beam members and column support members joined by tubular hubs and supported by a structural foundation.

FIG. 2*a* is an isometric view illustrating in more detail the arrangement of triangular units 1 into a structural gridwork 29 of beam members 2 and the positioning of the column support members 5 to form a structural framework. Tubular hubs 6 are positioned at each node of the structural gridwork 29. A connector means affixes the beam members 2 and the column support members 5 to the tubular hubs 6. The tubular hubs 6 also enable the structural framework to be anchored to a structural foundation 22. Rigid support panels 4 can be used to cover the structural gridwork 29 to form a flat surface.

Figure 2B:
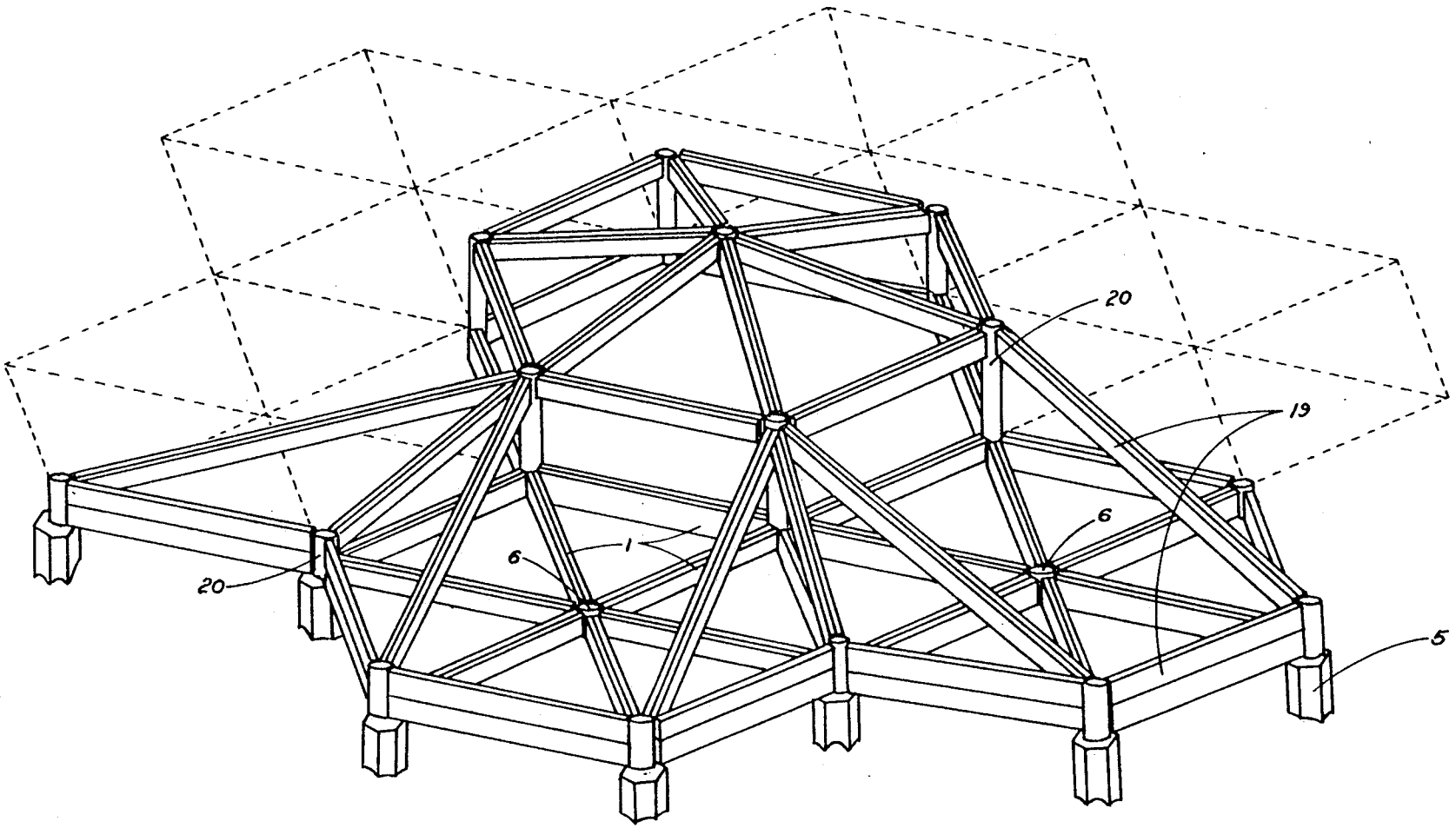
FIG. 2*b* is an isometric view illustrating roof framing members affixed to a structural framework using elongated tubular hubs.

FIG. 2*b* is an isometric view illustrating the use of elongated tubular hubs 20 for attaching roof framing members 19 to a structural framework. The elongated tubular hubs 20 enable beam members 2 of a structural gridwork 29 to be affixed at one end of the elongated tubular hub 20 and roof framing members 19 to be affixed at the opposite end. Variation of the tube length enables roof segments to be sloped.

Figure 3B:
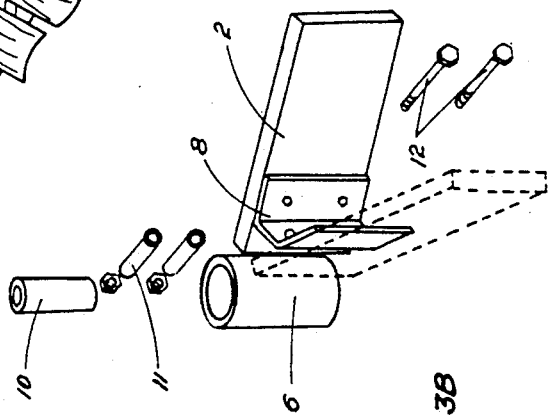
FIG. 3*b* is an isometric view illustrating in more detail the connector means of FIG. 3*b*.
Figure 3A:
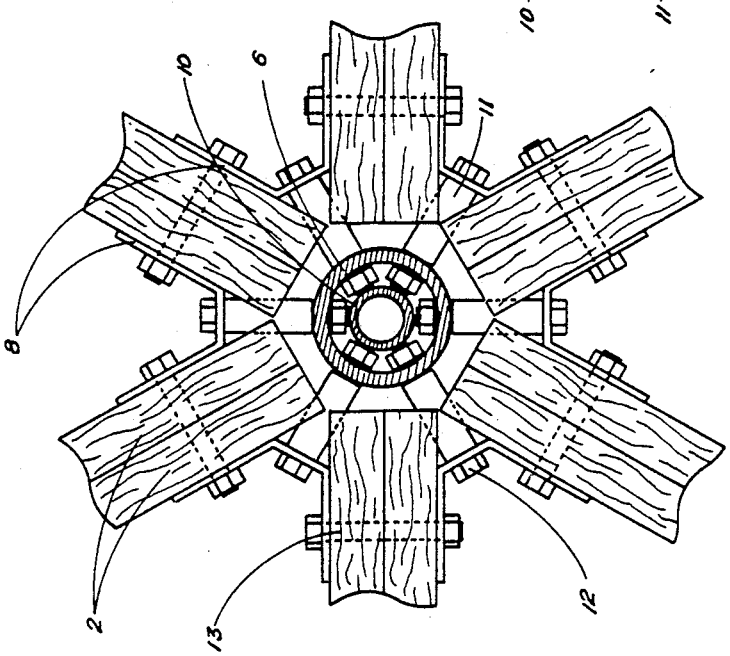
FIG. 3*a* is a plan view illustrating a connector means for attaching triangular units of beam members to a tubular hub.

FIG. 3*a* is a plan view illustrating a connector means for affixing beam members 2 assembled into triangular units 1 to a tubular hub 6. The connector means includes radial flange pairs 8 comprising two radial flanges 7, a radial bolt/nut unit 12, and a spacer tube 11 Bolts of the radial bolt/nut units 12 are first inserted through holes in the radial flange pairs 8 and then through holes in the tubular hubs 6. After tightening of the nuts of all radial bolt/nut units 12 at a node, an inner tubular sleeve 10 is inserted in the tubular hub for improved strength. Circumferential bolt/nut units 13 can be used additionally to connect adjacent triangular units 1.

FIG. 3*b* is an isometric view further illustrating the use of a radial flange pair 8 to affix a triangular unit 1 to a tubular hub 6. Three radial flange pairs 8 are used to join three beam members 2 to form a triangular unit 1. Nails or any other means which leaves the circumferential bolt holes unobstructed can be used to affix the radial flange pairs 8 to the beam members 2. The spacer tubes 11 slip over the radial bolts between the radial flange pair 8 and the tubular hub 6. The connector means in FIGS. 3*a* and 3*b* functions to affix a gridwork of beam members 1, which are joined at the vertices to form polygonal units, to tubular hubs 6 thereby integrating the individual polygonal units into a structural floor or ceiling unit.

Figure 4C:
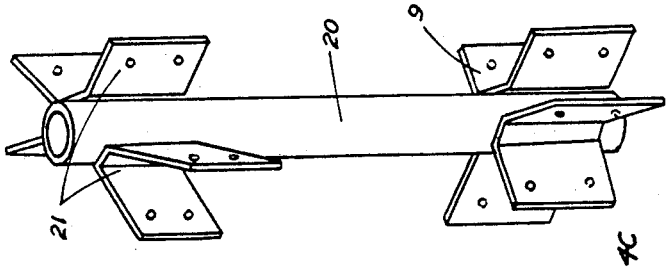
FIG. 4*c* is an isometric view of an elongated tubular hub with two sets of radial flanges.
Figure 4D:
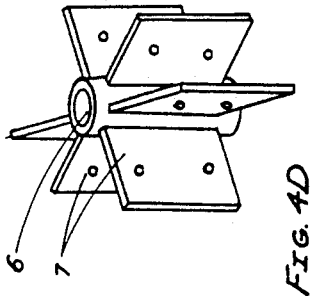
FIG. 4*d* is an isometric view illustrating radial flanges directly affixed to a tubular hub.
Figure 4A:
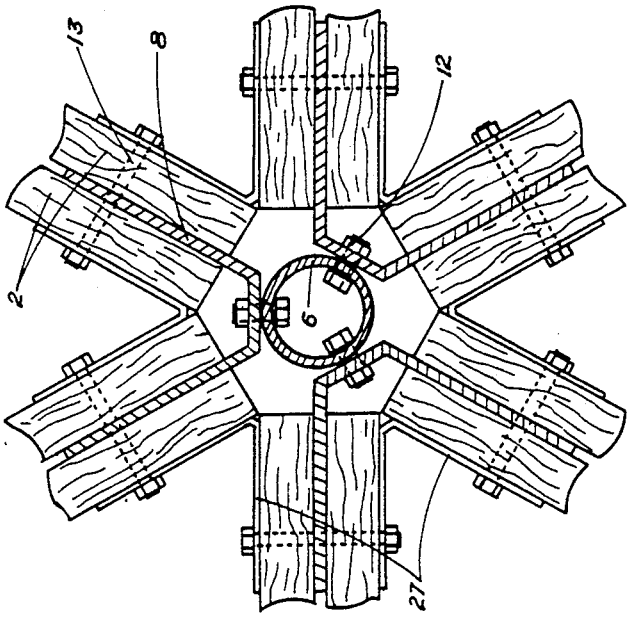
FIG. 4*a* is a plan view of a connector means for affixing beam members and triangular units to radial flanges directly affixed to a tubular hub.

Another connector means for affixing beam members 2 to a tubular hub 6 is shown in the plan view of FIG. 4*a*. In FIG. 4*a*, radial flange pairs 8 are directly affixed to the tubular hub 6. Beam members 2 are bolted to a radial flange with circumferential bolt/nut units 13. With this connector means, three beam members 2 joined at the ends using angle connectors 27 to form assembled triangular units 1 can be affixed to a tubular hub 6. The connector means of FIG. 4*a*. also enables a plurality of individual beam members 2 to be affixed to a tubular hub 6 using circumferential bolt/nut units 13. Individual beam members 2 may have kerfed ends enabling a member to be affixed to a radial flange using circumferential bolt/nut units 8. Radial bolt/nut units 12 or a welding process can be used to affix a radial flange pair 8 to a tubular hub 6.

Figure 4B:
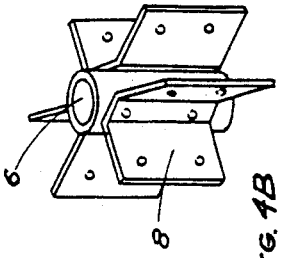
FIG. 4*b* is an isometric view illustrating the use of bolts to affix radial flanges to a tubular hub.

The isometric views of FIG. 4*b* and FIG. 4*a* illustrate two methods for affixing radial flanges to a tubular hub and further illustrates the connector means of FIG. 4*a*. As shown, a radial flange can be one of the two wings of a radial flange pair 8 or a radial flange is a single rectangular plate 7 directly affixed to a tubular hub 6 by a welding process. The connector means of FIGS. 4*a*, 4*b* and 4*d* enables a gridwork of individual beam members 2 or a gridwork of triangular units 1 to be affixed to a tubular hub thereby integrating the individual components into a structural floor or ceiling unit.

FIG. 4*c* is an isometric view illustrating an elongated tubular hub 20 with two sets of radial flanges located at opposite ends of an elongated tube. A first set of radial flanges 9 is affixed at the bottom end enabling the bottom end to affix to a gridwork of beam members 29. At the opposite or top end, a second set of radial flanges 21 is affixed to the elongated tubular hub. A second set of radial flanges 21 enables roof framing members to be affixed to the structural framework of beam members 2 and column support members 5. The distance between the radial flange sets varies depending on the desired slope of the roof segment. Roof framing members may be kerfed at the ends or bolted to the sides of the radial flanges 7.

The sectional view of FIG. 5 and the cross sectional views of FIG. 5*b* and 5*c* illustrate column support members 5 affixed to tubular hubs 6. An anchor bolt unit 18 passing concentrically through a tubular hub 6 and a column endpiece 14 enables a column support member 5 and a tubular hub 6 to be anchored to a structural foundation 22. The anchor bolt unit 18 comprises a hooked threaded rod, a large washer, and a nut. The tubular hub 6 extends a short distance into the foundation and into the column endpiece 14. Beam members 2 affixed to radial flanges 7 affixed to a tubular hub 6 are subsequently anchored to a foundation. A column bolt/nut unit 17 is used to affix two vertically aligned column support members 5 to a gridwork of beam members 2. The column bolt/nut unit comprises a threaded rod, large washers, and a nut. The threaded rod passes concentrically through a tubular hub 6 and engages both endpieces 14 of the column support members 5. FIGS. 5*a* and 5*d* shows the use of additional column bolt/nut units 17*a* may be passed peripheral to the tubular hub to provide increased rotational restraint to the ends of the beam members. Columns of hollow cross-section comprising column stanchions 15 removably affixed to lateral column ties 16 enable access for insertion and tightening the nuts of the column bolt/nut units 17 and tightening the nut of an anchor bolt unit 18. Lateral column ties 16 are spaced uniformly over the length of the columns and at the column ends. The structural foundation 20 consists of a set of isolated footings as shown in this figure. Continuous walls conforming to the pattern of the column support members 5 can also be used.

Figure 6C:
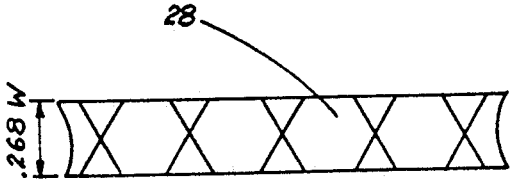
FIG. 6*c* illustrates the cutting of access cover panels from a rectangular panel strip.
Figure 6A:
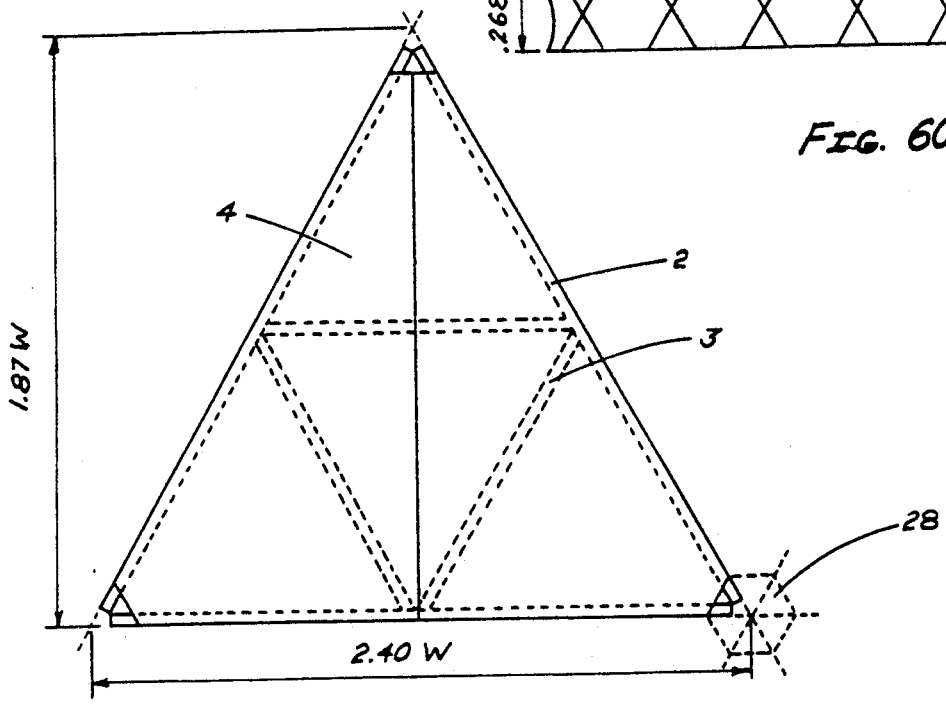
FIG. 6*a* illustrates details of a triangular unit to accommodate a 4 foot by 8 foot building panel.
Figure 6B:
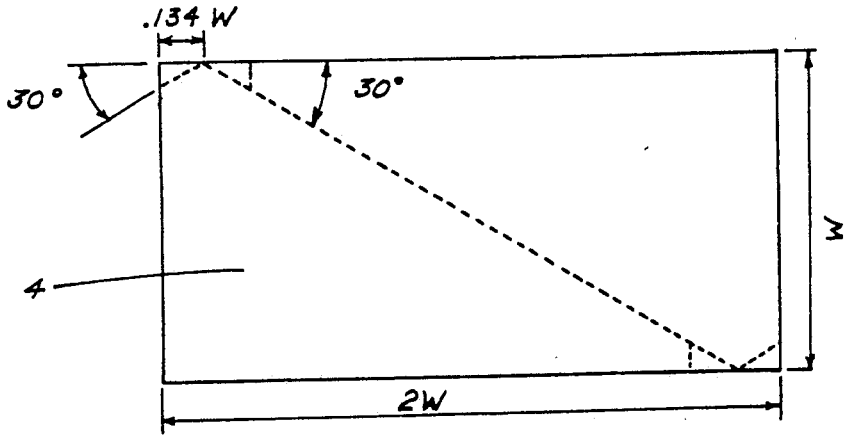
FIG. 6*b* illustrates how a standard rectangular building panel is cut to form a triangular unit.

FIG. 6*a* is a plan view illustrating an assembled triangular unit 1 that includes beam members 2, interior support members 3, and a rigid support panel 4. The triangular unit 1 is sized to accommodate a 4 ft. by 8 ft. flat panel which is commonly used in building construction. Dashed lines as shown in FIG. 6*b* indicate where the panel is cut to cover the space created by the beam members 2 and to provide access to affix a triangular unit 1 with attached rigid support panels 4 to a tubular hub 6. The access space is later covered by an access cover panel 28 cut from a strip of panel section as shown in FIG. 6*c*. Rigid support panels 4 may be attached at both the top and bottom of the triangular framework fabricated from the beam members 2 and the interior support members 3. Interior support members 3 are affixed at their ends to the beam members 2. Interior support members 3 may be positioned as shown in FIG. 6 or otherwise as determined from structural design considerations.

Figure 7:
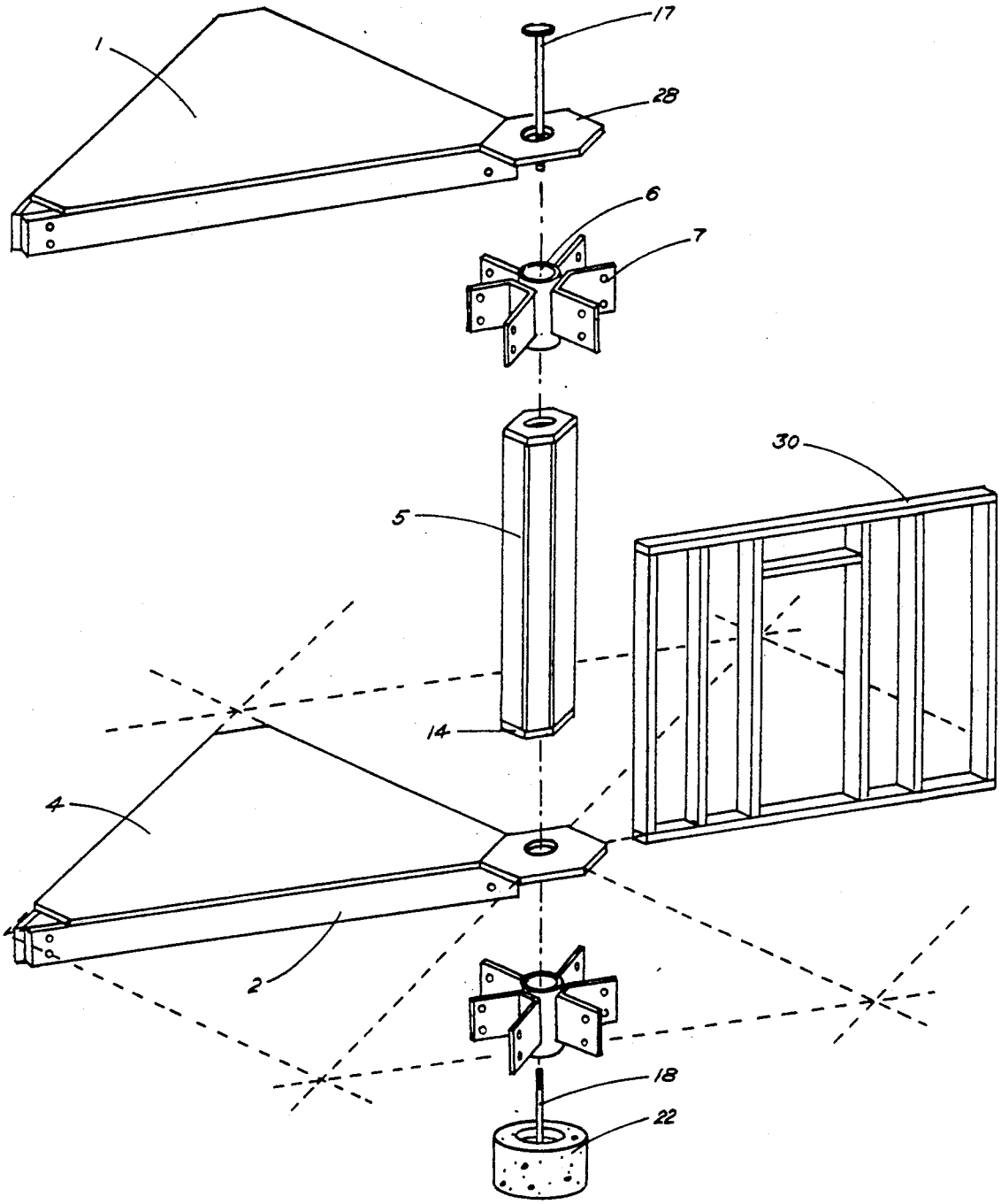
FIG. 7 is an isometric view further illustrating the modular components included in the building structure system.

FIG. 7 is an isometric view to further illustrate the assembly of a building structure from triangular units 1 made of beam members 2 and rigid support panels 4; hollow column support members 5 with endpieces 14; radial flanges 7 affixed to tubular hubs 6; a structural foundation 22 with anchor bolt units 18; access cover panels 28; column bolt/nut units 17; and wall units 30.

Figure 8:
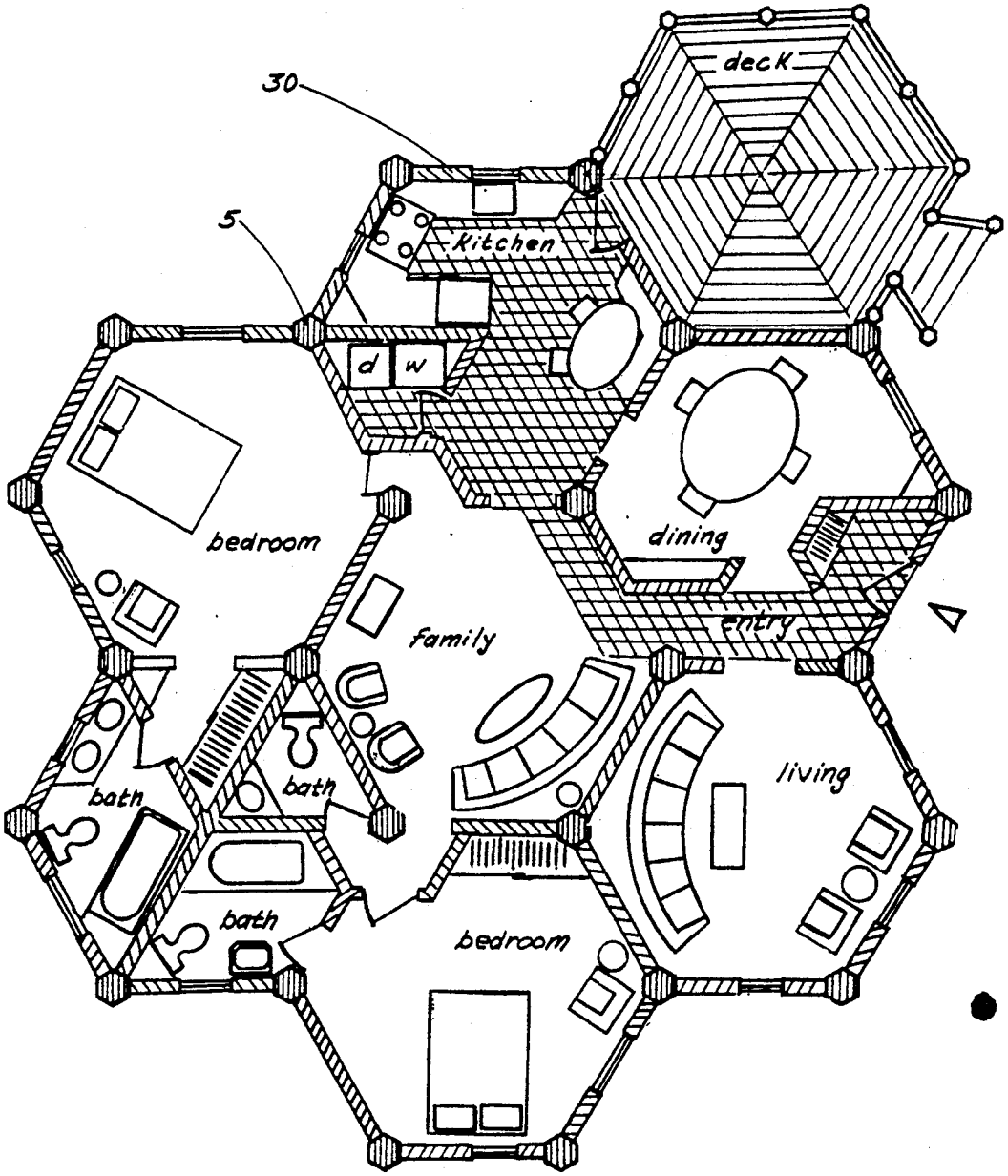
FIG. 8 is a floor plan illustrating an arrangement of columns and wall units to provide a dwelling unit.

FIG. 8 is a plan view of one arrangement of column support members 5 and wall units 30 to create a habitable living space. Standard wall units 30 extend from column to column to create hexagonal spaces. Non-standard wall units are used to further subdivide the hexagonal spaces. Column support members 5 with hexagonal cross-sections are advantageous since they provide a flat vertical surface for affixing the ends of wall units 30.

Although the description includes many specificities, these should not be construed as limiting the scope of the invention but as merely providing illustrations of the presently preferred embodiment of this invention. For example: the gridwork can be made of rectangular polygons, etc.; the columns can be rectangular, circular, etc. and may be solid; the columns can be attached to the gridwork with right-angle brackets, etc.; the beams and columns can be made of steel, concrete, plastic, etc.; the structural system may be applied to gazebos, churches, storage sheds, commercial structures, etc.; the planes of the assemblages of interconnected polygons can be skewed, etc.; the radial flanges instead of rectangular may be triangular to reduce weight, etc.; either one or a pattern of column bolt/nut units may be used to affix a column to a structural gridwork, etc.

Thus the scope of the invention should be determined by the appended claims and their legal equivalents, rather than by the examples given.

I claim:

1. A modular building structure system comprising:

a a plurality of beam members, each said beam member positioned between and aligned with two nodes of a planar assemblage of interconnected polygons and enabled to affix into a structural gridwork, said structural gridwork congruent with said planar assemblage of interconnected polygons;

b a plurality of column support members positioned between two said structural gridworks and aligned with two said nodes, one said node in each said structural gridwork, said column support members include endpieces enabling said column support members to be affixed to said structural gridwork, said beam members bear on said endpieces whereby forces are transferred between beams and columns in direct bearing; and c a connector means for removably affixing said beam members into said structural gridwork, said connector means additionally enabled to removably affix to ends of said column support members, said connector means comprises:

i a tubular hub, one said tubular hub positioned centrally at each node of said structural gridwork; and ii a radial flange set, said radial flange set includes a plurality of radial flanges spaced circumferentially around said tubular hub and extending in directions of said beam members, said radial flanges being enabled to affix to said tubular hub and said beam members being enabled to affix to said radial flanges.

iii a column bolt/nut unit, said bolt/nut unit comprising a threaded rod, a plurality of washers, and a nut; said threaded rod passing through said tubular hub and through said column endpieces enabling a clamping action to be applied to said beam members when said nut is tightened, wherein said clamping action provides rotational restraint to ends of said beam members.

2. The connector means of claim 1 further comprising additional column bolt/nut units, said additional bolt/nut units positioned around periphery of said tubular hub and also extending through endpieces of said column support member enabling additional clamping forces to be applied to ends of said beam members thereby providing greater rotational restraint.

3. The radial flanges of claim 1 wherein said radial flanges are two extensions of a radial flange pair.

4. The connector means of claim 3 further comprising a plurality of radial bolts, said radial bolts affix said radial flange pair to said tubular hub.

5. The connector means of claim 1 further comprising a plurality of circumferential bolt/nut units, said circumferential bolt/nut units enable said beam members to affix to said radial flanges.

6. The modular building structure system of claim 1 further comprising a plurality of roof framing members, said roof framing members enabled to affix to said endpieces of said column support members and to a structural gridwork.

7. The modular building structure system of claim 1 further comprising an elongated tubular hub enabling two sets of radial flanges to be circumferential spaced around and affixed to said tubular hub, said sets of radial flanges located at opposite ends of said tubular hub enabling said beam members to affix to one set of said radial flanges and said roof framing members to affix to said second set of said radial flanges, said second set of radial flanges extending in directions of said roof framing members, said elongated tubular hub enabled to affix to said column members.

8. The modular building structure system of claim 1 wherein:

a said polygons form an interconnected assemblage of triangles, said triangles further form a planar assemblage of interconnected hexagons, b said column support members are perpendicular to said planar assemblages of said interconnected triangles, and c said tubular hubs are aligned parallel to said column support members.

9. The modular building structure system of claim 6 wherein three said beam members are joined at the vertices to form a triangular unit, said triangular unit having planar top and bottom surfaces enabling a rigid support panel to be affixed to top and bottom surfaces of said triangular unit.

10. The triangular unit of claim 9 further comprising interior support members, said interior support members being affixed at the ends to said beam members, said rigid support panels additionally affixed to said interior support members.

11. The column support members of claim 1 wherein said column support member include stanchions, endpieces, and lateral column ties; said stanchions removably affixed to said lateral column ties and endpieces; said lateral column ties spaced in the longitudinal direction of said column support member.

12. The modular building structure system of claim 1 further comprising an anchor bolt unit; said anchor bolt unit comprises a threaded rod, a washer, and a nut; said anchor bolt unit enabling a structural framework comprising said structural gridworks and said column support members to be affixed to a structural foundation.

13. The connector means of claim 1 further comprising an inner tubular sleeve, said inner tubular sleeve positioned inside and concentric with said tubular hub and extending length of said tubular hub.

14. The modular building structure system of claim 10 wherein said triangular units are of specific dimensions enabling a four foot by eight foot rigid panel bisected symmetrically along a line making a thirty degree angle with the eight foot edge to cover the surface area of said triangular unit; the two rigid panel segments being additionally cut to provide access means for affixing said triangular unit to said tubular hub; said access means being covered by an access cover panel.

15. The modular building structure system of claim 1 further comprising a plurality of wall units, said wall units aligned with and positioned between said column support members, said wall units being enabled to affix to a structural framework, said structural framework comprising said structural gridworks and said column support members.

16. The modular building structure system of claim 1 further comprising an array of foundation footings centrally located below each column support member.

17. A connector means for assemblage of a structural framework, said connector means comprises:

a a tubular hub, said tubular hub positioned centrally at a node of a structural gridwork, said structural gridwork comprising a plurality of beam members;

b a radial flange set, said radial flange set comprises a plurality of radial flanges spaced circumferentially around said tubular hub and extending in directions of said beam members, said radial flanges being enabled to affix to said tubular hub and said beam members being enabled to affix to said radial flanges;

c a column bolt/nut unit, said column bolt/nut unit comprises a threaded rod, a plurality of washers, and a nut; said threaded rods passing through or positioned around periphery of said tubular hub and extending length of said tubular hub with projections sufficiently long to enable said column bolt/nut units to affix an endpiece of a column support member to said structural gridwork and to provide a clamping action to ends of said beam members affixed to said tubular when said nuts are tightened, thereby providing ends of said beam members with rotational restraint.

18. The radial flanges of claim 17 wherein said radial flanges are two extensions of a radial flange pair, said radial flange pair enabled to affix to said tubular hub.

19. The connector means of claim 16 further comprising a plurality of radial bolts, said radial bolts affix said radial flange pair to said tubular hub.

20. The connector means of claim 17 further comprising a plurality of circumferential bolt/nut units, said circumferential bolt/nut units enable said beam members to affix to said radial flanges.

21. The connector means of claim 17 further comprising an inner tubular sleeve, said inner tubular sleeve positioned inside and concentric with said tubular hub and extending length of said tubular hub.

22. The modular building structure system of claim 17 further comprising an elongated tubular hub enabling two sets of radial flanges to be circumferential spaced around and affixed to said tubular hub, said sets of radial flanges located at opposite ends of said tubular hub enabling said beam members to affix to one set of said radial flanges and said roof framing members to affix to said second set of said radial flanges, said second set of radial flanges extending in directions of said roof framing members, said elongated tubular hub enabled to affix to said column members.

* * * * *